United States Patent [19]

Nilsson

[11] Patent Number: 5,039,022

[45] Date of Patent: Aug. 13, 1991

[54] REFINER ELEMENT PATTERN ACHIEVING SUCCESSIVE COMPRESSION BEFORE IMPACT

[75] Inventor: Bengt Nilsson, Skoghall, Sweden

[73] Assignee: Kamyr AB, Karlstad, Sweden

[21] Appl. No.: 402,541

[22] Filed: Sep. 5, 1989

[51] Int. Cl.[5] ..... B02C 7/12

[52] U.S. Cl. ..... 241/261.1; 241/261.3; 241/296

[58] Field of Search ..... 241/261.2, 261.3, 296, 241/297, 298, 261.1; 162/26

[56] References Cited

U.S. PATENT DOCUMENTS

| | | | |
|---|---|---|---|
| Re. 29,053 | 11/1976 | Cumpston, Jr. . | |
| 407,326 | 7/1889 | Boehnlein | 241/296 |
| 1,098,325 | 5/1914 | Kihlgren | 241/261.3 X |
| 2,654,295 | 10/1953 | Sutherland | 241/261.3 X |
| 2,968,444 | 1/1961 | Jones | 241/261.2 X |
| 4,269,362 | 5/1981 | Berggren | 241/261.2 X |
| 4,754,935 | 7/1988 | Gullichsen . | |

FOREIGN PATENT DOCUMENTS

| | | | |
|---|---|---|---|
| 296860 | 3/1917 | Fed. Rep. of Germany | 241/296 |
| WO88/06490 | 9/1988 | PCT Int'l Appl. . | |
| 207540 | 2/1966 | Sweden . | |
| 396971 | 5/1979 | Sweden . | |

*Primary Examiner*—Mark Rosenbaum

*Attorney, Agent, or Firm*—Cushman, Darby & Cushman

[57] ABSTRACT

A refiner for producing mechanical pulp has greater spacing between bars of the refiner grinding elements than is conventional. The grooves between the bars have a sloping bottom, making an angle of about 1°-30° (preferably 5°-20°) with respect to a straight line between the bars. The width of the grooves is about 10-50 mm. The relative rotation of the refiner elements (whether disks, cylindrical, or conical) with respect to each other results in sequential refining: a moving tension field, with successive compressions before impacts, and expansions, achieving increased fiber flexibility, more fiber rolling motion, and less fiber cutting. Pulp produced has increased fiber flexibility yet maintains a high content of long fibers, and higher refiner capacity also ensues. Also, the refiner of the invention can be used to mix treatment chemicals—such as bleaching chemicals in liquid form—into kraft pulp at high consistency (e.g. about 30-55%).

3 Claims, 3 Drawing Sheets

REFINER ELEMENT PATTERN ACHIEVING SUCCESSIVE COMPRESSION BEFORE IMPACT

BACKGROUND AND SUMMARY OF THE INVENTION

An increasingly popular method of producing mechanical pulp for paper, paper board, and the like is refiner technology. In conventional refiners (whether using disks, or cylindrical or conical refiner elements), the lignin in the cellulosic fibrous material (e.g. wood chips, or the like) that provides the raw material for pulping, is softened by compression and decompression and by the friction of wood-to-wood and metal-to-wood provided by the relatively rotating refiner elements. A tension field is created utilizing the refiner bars for compression, shear forces, and decompression. A tension field exists between the bars. Most of the refiner energy applied is used to refine the fibers and improve the flexibility and bonding ability. Fiber rolling motion is desirable, but much fiber cutting action occurs.

According to the present invention, by increasing and tailoring the shear forces applied during mechanical refining of paper pulp, the fiber flexibility and paper strength properties are improved. According to the present invention, more fiber rolling motion is applied to the raw material, and less fiber cutting. Thus the intensity of the energy supply increases. The teachings of the invention can be applied to each kind of refiner element. Also, the technology is applicable to low frequency refining, such as disclosed in U.S. Pat. No. 4,754,935, the disclosure of which is hereby incorporated by reference herein.

Conventional refiners typically have parallel grooved bottoms between the bars except where the spacing between the refiners (grooved width) is very small. In the latter situation, the grooved bottom is typically curved, having a radius of curvature. This results in all of the compression, shear forces, and decompression taking place when the refiner bars are aligned with each other on the relatively rotating refiner elements.

According to the present invention, an apparatus and method are provided for producing a mechanical pulp having increased fiber flexibility, while the content of long fibers thereof is maintained at a high proportion. This is accomplished, according to the invention, by providing grooves of a slightly greater width than is conventional between the bars of the refiners, and providing a sloping bottom of the grooves in order to provide additional shearing forces. Typically, a refiner element according to the invention has a groove width of about 10–50 mm, and the grooved bottom slopes downwardly from adjacent one bar to adjacent the next bar at an angle of about 1°–30° (preferably about 5°–20°) to a straight line between the bars. The relatively rotatable refiner elements according to the invention have comparable configurations, and desirably the widths of the grooves on the elements are the same, integer multiple of the number of bars of one element than of the other element.

Utilizing the refiner elements according to the invention and effecting relative rotation therebetween, a method of refining—with the coined name of "Sequential Refining"—is possible. According to the method of the invention, refining of a slurry of cellulosic fibrous material into paper pulp is effected by causing relative rotational movement of the refiner elements with respect to each other to continuously and successively provide a moving tension field, with successive compressions before impacts, and expansions, to achieve increased fiber flexibility, more fiber rolling motion and less fiber cutting than conventional refining.

During the practice of the invention, the consistency of the slurry is always between about 30–55% solids. In addition to producing RMP, the invention can be practiced to produce thermomechanical pulp (TMP), chemimechanical pulp (CMP), and chemithermomechanical pulp (CTMP), or other high-yield or mechanical pulps by related methods of production.

The invention is capable of supplying increased shear forces by utilizing a moving tension field, with successive compressions before impact, and expansions, achieving increased fiber flexibility, more fiber rolling motion, and less fiber cutting, than conventional refining. Increased paper strength properties, and higher refiner capacity due to higher intensity of energy supply resulting in lower demand of specific energy, ensue. The invention teachings are applicable to all conventional types of refiner segments, including disks (single disk or double disk), cylinders, or conical refiner elements.

The refiner of the invention may also be utilized for mixing chemicals into kraft (chemical) pulp. By passing kraft pulp at high consistency (e.g. 30–55%) and chemicals through a refiner, the moving tension field produced according to the invention achieves fiber rolling and kneading action, the chemical penetrating the fibers. Through the action of the inherent great number of pulsations, the liquid inside and outside the fibers is equalized with treatment chemical (e.g. bleaching liquid). Thus treatment chemical can be evenly distributed in the pulp at high consistency and temperature. This results in reduced chemical consumption for a given treatment (e.g. bleach) level, and enormous savings in equipment space requirements.

It is the primary object of the present invention to provide for the production of mechanical pulp with increased fiber flexibility at a maintained high content of long fibers. This and other objects of the invention will be seen from an inspection of the detailed description of the invention, and from the appended claims.

DETAILED DESCRIPTION OF THE DRAWINGS

Figure 1:
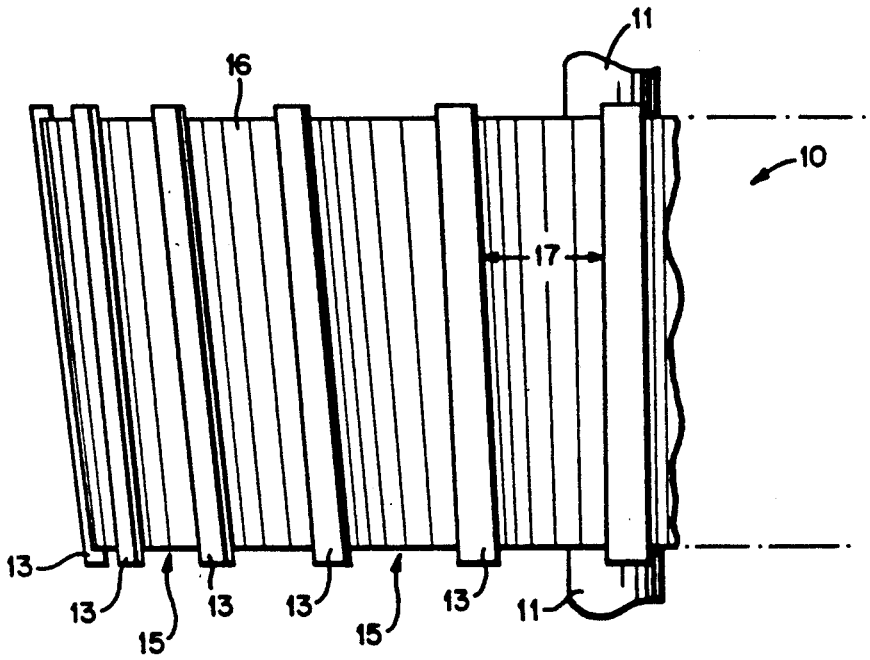
FIG. 1 is a top plan view of a part of an exemplary conical refiner rotor according to the invention.

A conical refiner element, typically a rotor, according to the invention is shown generally by reference numeral 10 in FIG. 1. The refiner element 10 is rotatable about a shaft 11, and cooperates with a stator element (not shown) having a comparable construction. The refiner element 10 includes a plurality of bars 13 which upstand from the surface thereof, with grooves 15 between the bars 13. As can be seen in the left-most portion of FIG. 1, the grooves 15 having a sloping bottom 16, the bottom sloping downwardly from adjacent one bar 13 to the next bar 13, at an angle to a straight line between the bars. Typically that angle is about 1°-30°, preferably about 5°-20°. The spacing between the bars 13 is slightly greater than conventional in order to accommodate the sloping bottoms 16 of the grooves 15, for example the width 17 of the grooves 15 is between about 10-50 mm. In this embodiment the bars 13 are generally parallel.

Another embodiment of the invention, showing the relative shape and relationship between components and its operation to practice "Sequential Refining", is illustrated in FIGS. 2 through 5. In this embodiment, the first and second refiner elements 20, 21 are illustrated as disk refiners which are relatively rotatable with respect to each other; e.g. the refiner element 20 is a rotor, rotating in the direction of arrow 22, driven by a conventional motor (not shown) or the like, and the element 21 is a stator.

The disk refining elements 20, 21 are substantially identical, and are disposed in opposed face-to-face relationship. The element 20 has a plurality of bars 24 with flat top surfaces of predetermined width, with grooves having a sloping bottom 25 between the bars 24. Each sloping bottom 25 slopes from a point 26 adjacent one bar 24, downwardly to a point 27 adjacent the next successive bar 24 in the direction of rotation 22. The bottom 25 makes an angle $\alpha$ with respect to a straight line between successive bars 24. The angle $\alpha$ is between about 1°-30°, preferably about 5°-20° (12° in the embodiment illustrated in FIGS. 2 through 5). The width 28 of each of the grooves is between about 10-50 mm.

The stator 21 has bars 30 with grooves having sloping bottoms 31 therebetween. Preferably the configuration and width of the bars 30 is the same as that of the bars 24. The sloping bottom 31 of each groove slopes from a point 32 adjacent one bar 30, to a point 33 adjacent the next successive bar. The width of each groove is designated by reference numeral 34. Preferably the stator 21 is essentially identical to the rotor 20 as far as the surface configuration is concerned, meaning that the slope of the surface 31 is the same as the slope of surface 25, and the width 34 is the same as the width 28. The bars 24 can be parallel to each other, or—as is more typical in disk refiners—can extend radially along the surface of the disk. The bars 30 would have the same configuration (i.e. either parallel or radial) as the bars 24.

Figure 2:
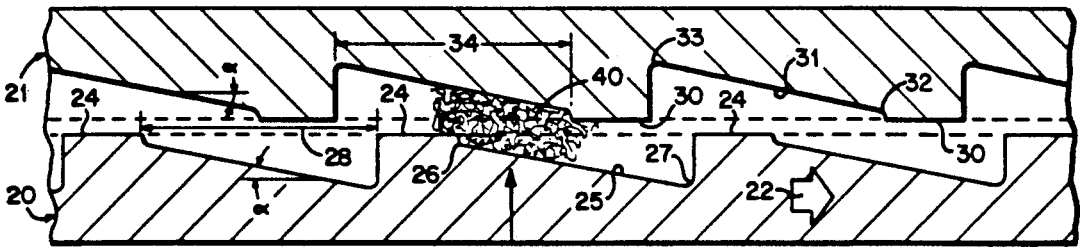
FIGS. 2–5 are sequential longitudinal cross-sectional views of a portion of exemplary refiner rotor and stator disks according to the invention, showing the operation thereof to refine wood chips.
Figure 3:
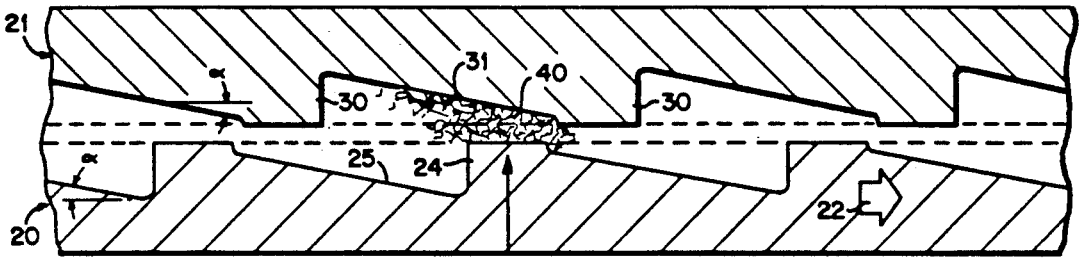
Figure 4:
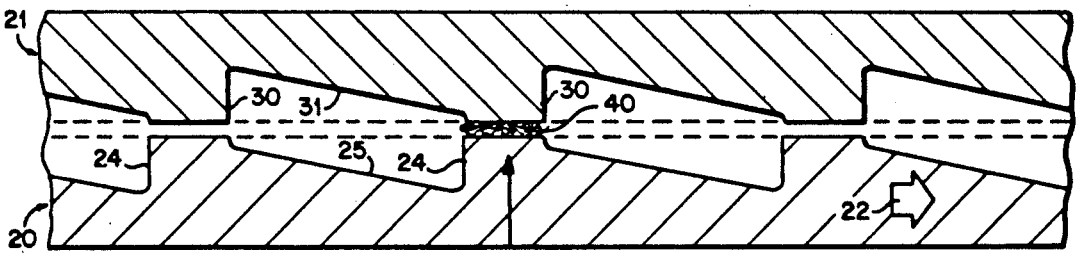
Figure 5:
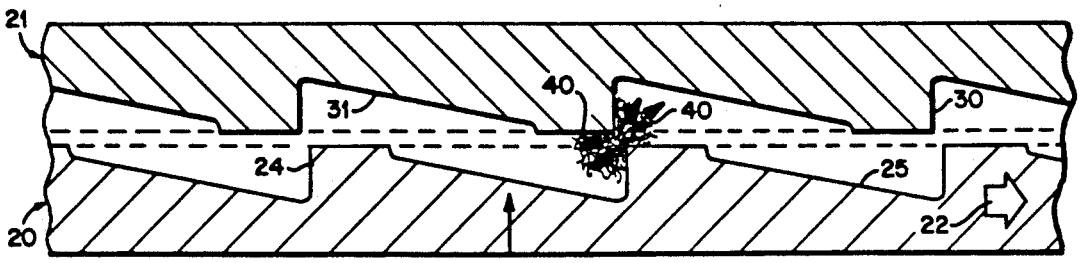

FIG. 2 shows the relative position between the rotor and stator components during the creation of successive fiber compressions in a movable tension field. Cellulosic fibrous material 40 is being successively compressed and sheared between the surfaces 25, 31 and their associated bars 24, 30 as the rotor moves in the direction of arrow 22. The compression and shearing are enhanced in the position illustrated in FIG. 3, and finally there is an impact position illustrated in FIG. 4 wherein the bars 24, 30 are aligned. Note that in this embodiment when alignment between the bars 24, 30 occurs, the aligned grooves have the configuration of a parallelogram when viewed in cross-section. After the impact, which is a stationary sequence, of FIG. 4, there is an expansion phase illustrated in FIG. 5, also a stationary sequence. This "Sequential Refining" (FIGS. 2-5) action increases the flexibility of fibers of the material 40, while maintaining a high content of long fibers. This action takes place continuously, and sequentially, during the entire refiner operation.

Figure 6:
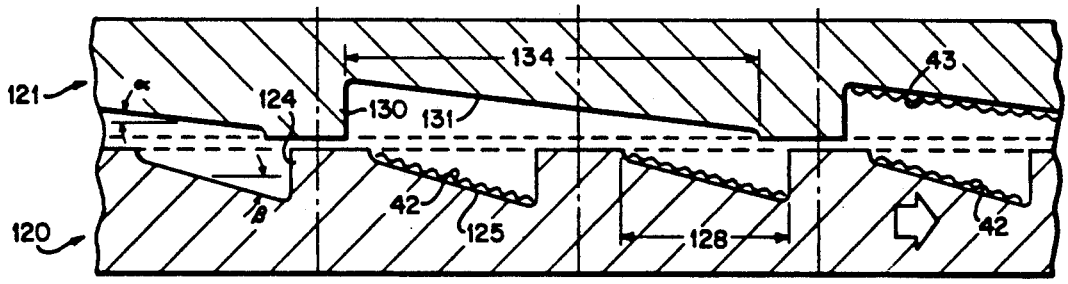
FIG. 6 is a longitudinal cross-sectional view of a portion of a second embodiment of rotor and stator disks according to the invention.

Another embodiment of refiner surface configurations is illustrated in FIG. 6. In this embodiment structures comparable to those in the FIGS. 2 through 5 embodiment are illustrated by the same two digit reference numeral, and preceded by a "1". In this embodiment, the rotor 120 has twice as many bars 124 as the stator 121 has bars 130. That makes the width 134 of the groove between the bars 130 more than twice as much as the width 128 of the groove between the bars 124. That means that the slope angle $\alpha$ of the bottom 131 is significantly less than the slope angle $\beta$ of the bottom surface 125. For the exemplary embodiment illustrated in FIG. 6, the angle $\alpha$ is about 7° and the angle $\beta$ is about 16°.

In the FIG. 6 embodiment, another modification that may be utilized with any embodiment according to the invention is also illustrated. An abrasive coating 42 is provided on the surfaces 125, and optionally an abrasive coating 43 may be provided on the surfaces 131. The abrasive surface provided by coatings 42, 43 operates to allow the refiner to achieve an additional shearing force effect. The abrasive coatings 42, 43 may be applied by any conventional techniques for applying abrasive onto the conventional metals (e.g. stainless steel, nickel-hardened steel, or the like) of which refiner disks 120, 121 are made.

Figure 7:
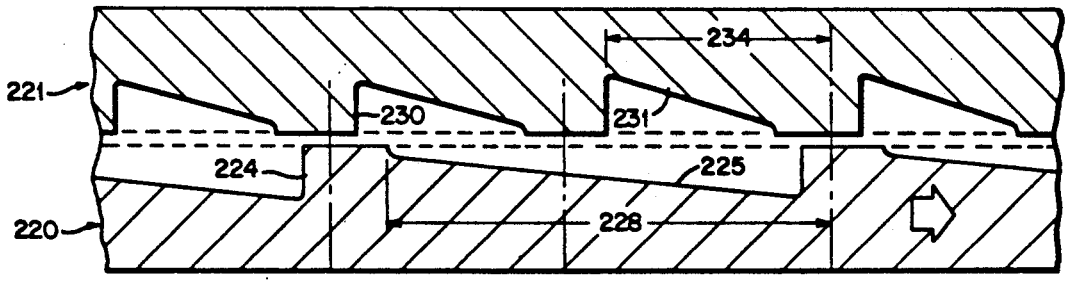
FIG. 7 is a longitudinal cross-sectional view of a portion of a third embodiment of rotor and stator disks according to the invention.

In the embodiment in FIG. 7, structures comparable to those in the FIGS. 2 through 5 embodiment are illustrated by the same two digit reference numeral preceded by a "2". In this embodiment, the rotor 220 has one-half the bars 224 of the stator 221. Thus the slope of the surface 225 will be less than half of that of the slope of the surface 231, and the spacing 228 will be greater than twice that of the spacing 234.

Figure 8:
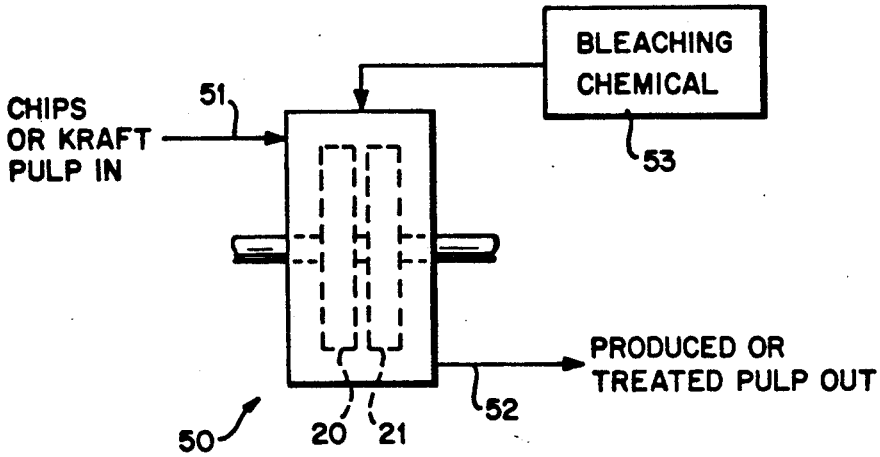
FIG. 8 is a schematic view showing an exemplary refiner according to the present invention used to effect mixing of chemical with the mechanical pulp during refining, or to mix chemical with kraft pulp.

FIG. 8 schematically illustrates a refiner 50 according to the invention, having relatively rotatable disk refiner elements 20, 21. Wood chips, or like cellulosic fibrous raw material is fed in inlet 51 to the refiner 50, and refined pulp is removed via the pulp outlet 52. The refiner 50 according to the invention has numerous advantages as far as mixing of chemicals with the fibers is concerned, and the intimate mixing provided thereby results in potential savings in chemical consumption. Therefore according to the invention it is also feasible to add bleaching chemical from source 53 directly to the refiner 50 so that the bleaching chemical is mixed with the fibers between the relatively rotating disks 20, 21. For example peroxide bleaching chemical can be added to the refiner 50, resulting in high temperature bleaching at high pulp consistency with intimate mixing. Other chemicals could be added, such as alkali, instead of or in addition to the bleaching chemical, to the refining zone. During refining, the consistency of the slurry of cellulosic fibrous material/pulp is typically between about 30-55% solids.

The invention is applicable to the production of RMP, TMP, CMP, and CTMP. The material is pretreated prior to being fed in line 51 to the refiner 50 during the production to TMP, CMP, or CTMP, and/or subsequently treated after being discharged in pulp discharge 52. The invention is also particularly advantageous when utilized in association with low frequency refining, as disclosed in U.S. Pat. No. 4,754,935. The invention is applicable to refiner elements having surfaces of revolution (i.e. cylindrical or conical), or disk configurations, with a wide variety of spacings between the rotatable refining elements. The refiner 50 illustrated in FIG. 8 may be the only refiner (e.g. for example if low frequency refining is practiced), or may be the first refiner of a series of refiners, or the second (typically last) refiner in a series of refiners.

The mechanical pulp produced according to the sloping groove bottom refiners of the invention has enhanced properties compared to pulp produced by otherwise identical refiners from the same raw material. The pulp according to the invention has increased fiber flexibility yet maintains a high content of long fibers. The practice of the invention through the utilization of the moving tension field of successive compressions before impacts, and expansions, has more fiber rolling motion and less fiber cutting, and therefore the strength properties of paper produced by pulp according to the invention should be increased. Also, there is higher refiner capacity due to a higher intensity of energy supply resulting in a lower demand of specific energy.

The refiner 50 illustrated in FIG. 8 also may be used as a mixer for mixing chemicals, such as bleaching chemicals from a source 53, into kraft pulp flowing in line 51. The moving tension field which achieves successive compressions with fiber rolling and kneading action is very useful for mixing chemicals with pulp at high consistency, e.g. about 30–55% solids. By adding the bleaching chemical 53, such as hydrosulfite, chlorine, chlorine dioxide, hydroxide, etc. to the pulp in the refiner 50, an efficient mixing action of liquid and fibers takes place, the liquid penetrating into the fibers. This is a result of the large number of pulsation repetitions which are inherent in refiner 50 operation, in which the liquid inside and outside the fiber is equalized with bleaching agent present. Utilizing the refiner 50 in this manner it is possible to very evenly distribute expensive bleaching chemicals, or like treatment chemicals, into the pulp at a high consistency and temperature, resulting in large equipment space requirement savings, and reduced chemical consumption.

While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended so as to encompass all equivalent structures, procedures, and products.

What is claimed is:

1. A cellulosic pulp refiner comprising:

two cooperating refiner elements, each element comprising a surface with surface manifestation thereon, the surface manifestations including a plurality of upstanding bars with two parallel edges, the bars being spaced from each other along said surface so that a longitudinal groove is defined between successive bars, said groove having a bottom which slopes downwardly from adjacent one bar to adjacent the next bar at an angle of about 1°–30° to a straight line between the bars, said groove having a width of about 10–50 millimeters, an abrasive means being disposed on said bottom for enhancing shearing action; and means for mounting the refiner elements for relative rotation with respect to each other so that when respective bars are aligned the deepest portion of a groove on one element surface corresponds to a shallow portion of a groove on the other element surface.

2. The cellulosic pulp refiners of claim 1, wherein the bars on each of said refiner elements are parallel to each other, and wherein said angle of each sloping bottom is about 5°–20 °.

3. The cellulosic pulp refiner of claim 1, wherein said angle of each sloping bottom is about 5°–20 °.

* * * * *